US011417180B2

(12) United States Patent
Izod et al.

(10) Patent No.: US 11,417,180 B2
(45) Date of Patent: Aug. 16, 2022

(54) DOOR ALARM

(71) Applicant: SAFEHINGE LIMITED, Glasgow (GB)

(72) Inventors: Martin Izod, Glasgow (GB); Gus Thomas, Glasgow (GB)

(73) Assignee: SAFEHINGE LIMITED, Glasgow (GB)

( * ) Notice: Subject to any disclaimer, the term of this patent is extended or adjusted under 35 U.S.C. 154(b) by 0 days.

(21) Appl. No.: 17/055,420

(22) PCT Filed: May 14, 2019

(86) PCT No.: PCT/GB2019/051308
§ 371 (c)(1),
(2) Date: Nov. 13, 2020

(87) PCT Pub. No.: WO2019/220889
PCT Pub. Date: Nov. 21, 2019

(65) Prior Publication Data

US 2021/0225142 A1 Jul. 22, 2021

(30) Foreign Application Priority Data

May 14, 2018 (GB) ..... 1807803

(51) Int. Cl.

| | |
|---|---|
| ***G08B 13/08*** | (2006.01) |
| ***E05C 19/02*** | (2006.01) |
| ***G08B 21/02*** | (2006.01) |
| ***G08B 25/00*** | (2006.01) |

(52) U.S. Cl.
CPC ..... *G08B 13/08* (2013.01); *E05C 19/02* (2013.01); *G08B 21/02* (2013.01); *G08B 25/008* (2013.01); *E05Y 2900/132* (2013.01)

(58) Field of Classification Search
CPC ..... G08B 13/08; G08B 21/02; G08B 25/008; E05C 19/02; E05Y 2900/132
See application file for complete search history.

(56) References Cited

U.S. PATENT DOCUMENTS

| | | | | |
|---|---|---|---|---|
| 7,999,690 | B1 * | 8/2011 | Shi | G08B 21/22 340/666 |
| 8,803,689 | B2 * | 8/2014 | Berger | E05B 63/248 292/144 |
| 2010/0194563 | A1 * | 8/2010 | Berner | G01G 19/52 340/545.1 |
| 2011/0016971 | A1 | 1/2011 | Yulkowski et al. | |
| 2019/0266862 | A1 * | 8/2019 | Harrison | G08B 21/0461 |
| 2020/0208436 | A1 * | 7/2020 | Colligan | G08B 5/36 |

FOREIGN PATENT DOCUMENTS

| | | |
|---|---|---|
| GB | 2490663 | 11/2012 |

OTHER PUBLICATIONS

International Search Report; PCT/GB2019/051308; dated Jun. 13, 2019.

* cited by examiner

*Primary Examiner* — Toan N Pham
(74) *Attorney, Agent, or Firm* — Dickinson Wright PLLC

(57) ABSTRACT

A method of detecting a ligature on a door is provided whereby the load applied by the door to a load sensing means and the movement of the door relative to the door frame are used to determine whether a ligature is being applied to the door to thereby trigger an alarm. Apparatus for carrying out the method is also provided.

21 Claims, 16 Drawing Sheets

A

B

A

B

C

DOOR ALARM

CROSS-REFERENCE TO RELATED APPLICATIONS

The present application is a Section 371 National Stage of International Application PCT/GB2019/051308, filed 14 May 2019, and through which priority is claimed to UK Patent Application 1807803.0, filed 14 May 2018.

FIELD OF THE INVENTION

The present invention relates to the technical field of door alarms, more specifically to door alarms that may detect a ligature on the door to which the door alarm is installed.

BACKGROUND OF THE INVENTION

There are a number of institutions within which there is a risk that patients or inmates of those institutions may seek to end their lives. One example of such an institution is in mental health institutions. One common way that patients may seek to commit suicide is to make a ligature on a door from which the patient can attempt to hang or suffocate themselves through strangulation. Such ligatures can be formed by anything upon which a cord can be tied around, trapped within or at any point where two hard surfaces meet (a so-called "ligature point"). For example, ligature points may be formed between the top of the door and the door frame, the latch of the door and the door frame, the hinges of the door and the door frame, or the threshold or bottom of the door and the floor.

Accordingly, it is of paramount importance that staff and healthcare providers in such institutions have systems in place that will alert them to an attempted ligature so that they are able to prevent fatalities.

One solution is to provide an alarm on the top of the door of the room of a patient that is considered to be at risk. Typical alarms are located at the top of the door and consist of a switch along the top of the door. When a ligature is placed over the door and weight is applied the contacts close and the alarm is activated. Unfortunately, such systems are only able to detect ligatures located at the top of the door and are unable to detect ligatures at any other point around the door.

These systems are typically readily visible when installed, and as such contribute to an institutional feel by introducing a large amount of metal to the door. This amount of metal can potentially compromise the fire safety of the door, and such high visibility allows patients to readily determine whether a given room is alarmed or not, allowing any patient intent on suicide to select a door that is not alarmed, if available.

Furthermore, these systems are limited in their sensing ability in that the switch is a binary input that triggers due to a specific load (i.e. not adjustable) in only one direction. As a result, such systems are not readily able to prevent false alarms and are prone to accidental triggering or intentional false alarms. For example, such systems can be set off by wet towels being placed over the top of the door, hitting the door frame as the door moves when the building settles or patients intentionally setting them off to create nuisance with staff. The relative ease at which the alarm can be falsely set off risks staff turning off the devices and missing a ligature attempt.

Another issue with prior systems is that they are typically hardwired into existing systems, increasing the cost of installation.

Therefore, there is a need for an improved alarm system for detecting ligatures on a door with higher accuracy and that can detect ligatures at any potential ligature point around a door.

Accordingly, at least some aspects of the present invention are directed at providing an improved door alarm.

SUMMARY OF THE INVENTION

According to a first aspect of the invention there is provided a method of detecting a ligature on a door, the method comprising the steps:

(i) providing a door mounted within a door frame on mounting means, movement sensing means configured to determine whether the door is moving relative to the door frame, load sensing means configured to determine the load applied by the door to the mounting means, and processing means;

(ii) determining whether the door is substantially stationary using the movement sensing means;

(iii) when the door is determined to be substantially stationary, determining the load applied by the door a plurality of times to provide a plurality of load readings;

(iv) averaging the plurality of load readings to produce an average load reading;

(v) calculating a threshold value from the average load reading; and (vi) determining the load applied by the door; and (vii) determining whether the load applied by the door in step (vi) is greater than the threshold value, wherein a load that is greater than the threshold value is indicative of a ligature on the door.

It has been found by the inventor that typical doors used in mental health institutions, for example, have a great variance in the apparent weight of the door as measured by the load sensor. This may be due to movement of the fabric of the building as the doors open due to the large weight of the door. As a result, the door may deflect the wall as it is moved, and the wall does not settle to the same position each time after the door is opened or closed, resulting in the observed great variance in the apparent weight of the door and not the consistent baseline reading you would expect.

Therefore, it is currently not possible to set a static baseline for the weight of the door upon installation. In addition, the high variance (+/−20 kg apparent load, for example) means it is unrealistic to just set a higher threshold to attempt to overcome this variance.

The inventors have found that by taking a plurality of readings of the load applied by the door each time that the door has been determined to be substantially stationary after being determined to be moving allows a more accurate baseline and threshold to be derived, thereby allowing abnormal loads resulting from ligature attempts to be more reliably detected.

In the method of the present aspect, averaging the plurality of load readings may set a base line load that is considered to be the "normal" load applied by the door to the mounting means. Accordingly, the baseline reading in the method of the present aspect may be more accurate than taking a single load reading as the baseline thereby allowing the calculated thresholds to be significantly narrower than would otherwise be the case. A "narrower" threshold value is typically closer in value to the average load reading or base line load than a wider threshold value. Accordingly, the method of the present aspect may be configured to detect smaller additional loads applied by the door due to ligatures or similar than other methods in the art. For example, the threshold value may be the baseline value plus or minus 2 kg, 3 kg, 4 kg, or 5 kg.

In some embodiments the processing means may calculate a plurality of threshold values. The plurality of threshold values may each be calculated in a different way and may correspond to different calculated parameters. The plurality of threshold values may be calculated in the same way and may use different, the same or overlapping data sets. At least two of the plurality of threshold values may be calculated in the same way. At least two of the plurality of threshold values may be calculated in a different way.

Typically, the processing means produces the average load reading. The processing means may calculate the or each threshold value from the average load reading. The processing means may determine whether a subsequently determined load applied by the door is greater than the or each threshold value.

In some embodiments, steps (iii) to (v) may be carried out continuously to provide a continuous average or rolling average load reading and calculate threshold values continuously that automatically adjust to the rolling average load reading.

In some embodiments the load may be determined when the door is determined to be slowing down to allow the average load reading when the door is substantially stationary to be compared to the determined load as the door is slowing down as the door is opened or closed, for example.

In some embodiments, the average load reading may be compared to average load readings that have been calculated previously. For example, the average load reading may be compared to average load readings from when the door was previously substantially stationary. The average load reading may be adjusted to bring it within a predetermined range of the previously recorded average load readings.

By the term "ligature point" we refer to any anchor point that may be used to apply a force that may be used to suffocate or hang a person. For example, any point at which a door and a door frame contact can be a ligature point and therefore used to form a ligature or attach a ligature to the door.

By the term "the door is determined to be substantially stationary" we refer to both the door being determined to be stationary and to the door moving at speeds that are close to stationary. For example, a door that is determined to be substantially stationary may be stationary, or may be moving around the pivot of the hinge by less than 3-10 degrees per second. Alternatively, a door may be determined to be substantially stationary if the door does not move out with a range of 0-10 degrees from a given position.

A door that is determined to be substantially stationary may be closed, typically wherein the door fully occludes the door frame. A door that is determined to be substantially stationary may be open. A door that is determined to be substantially stationary may be ajar i.e. it is not closed and is not fully open.

In some embodiments the method may determine whether the door is substantially stationary in the closed position. The method may determine whether the door is substantially stationary in the substantially closed position. For example, the method may determine whether the door is substantially stationary within a range of angles from the closed position, such as 0-10 degrees, 0-7 degrees or 0-5 degrees from the closed position. The method may only carry out steps (iii) to (vii) when the door is determined to be substantially stationary in the closed or substantially closed position.

Preferably, steps (ii) to (v) may be carried out every time the door becomes substantially stationary after moving. The baseline may be substantially the same for the door once the door has become substantially stationary, and therefore, it is not necessary to continuously calculate the average load reading and to calculate the threshold value.

In some embodiments steps (ii) to (v) may be carried out periodically after the door is determined to be substantially stationary. In this way any drift in the determined load applied by the door to the mounting means may be taken into account. As a result, false alarms due to drift in the baseline reading may be taken into account.

Typically, where the processing means determines that the load applied by the door is not greater than the threshold value, steps (vi) and (vii) are repeated to continuously monitor whether a ligature is being made at a ligature point between the door and the frame. For example, steps (vi) and (vii) may be repeated ten times every second, five times a second, twice a second, once a second, once every 10 seconds, once every 30 seconds or once every minute. In other examples, steps (vi) and (vii) may be carried out continuously to thereby continuously monitor the load applied by the door.

In some embodiments, steps (vi) and (vii) may be repeated at a first rate for a first time period after the door is determined to be substantially stationary, and steps (vi) and (vii) may be repeated at a second rate for a second subsequent time period after the door is determined to be substantially stationary. Typically, the first rate is faster than the second rate such that steps (vi) and (vii) may be repeated multiple times a second (the first rate) for the first period and steps (vi) and (vii) may be repeated once every multiple seconds (the second rate) for the second period. The first rate may be once every 0.05 seconds, 0.1 seconds, 0.2 seconds, or 0.5 seconds. The second rate may be once every second, once every 2 seconds, once every 5 seconds, once every ten seconds, once every 20 seconds, or once every 30 seconds.

In embodiments, step (vii) may comprise determining whether the load applied by the door becomes greater than the threshold value for at least a specified period. Accordingly, the method may require the load applied by the door to be greater than the threshold value for a minimum period of time before it is determined that there is a ligature on the door. In this way, the method of the present aspect may prevent or minimise false alarms due to spikes in the determined load applied by the door due to events such as people walking past the door, transient building movements, and more seriously, attacks on the door.

The specified period may be 0.5 seconds 1.0 second, 1.5 seconds, 2.0 seconds, 3.0 seconds, 4.0 seconds, 5.0 seconds, or 10 seconds. The specified period may be from 1 second to 10 seconds. The specified period may be from 1.0 second to 5.0 seconds. The specified period may be from 2 to 3 seconds.

In some embodiments, step (v) may comprise calculating a positive threshold value and a negative threshold value from the average load reading. Accordingly, step (vii) may comprise determining whether the load applied by the door becomes greater than the positive threshold value or becomes less than the negative threshold value, and wherein a load applied by the door that is either greater than the positive threshold value or is less than the negative threshold value may be indicative of a ligature on the door.

The movement sensing means may comprise any conventional device that can detect movement of the door and thereby determine when the door is substantially stationary or when the door is moving. For example, the movement sensing means may be an accelerometer, a magnet and magnetic angle sensor, an encoder, an optical encoder, or a potentiometer.

In embodiments, a communication means may be provided, and the method may comprise the step (viii) when the load applied by the door is determined to be greater than the threshold value, communicating to an external alarm system via the communication means to activate the external alarm.

In embodiments where the method requires the load applied by the door to be greater than the or each threshold value for a minimum period of time before it is determined that there is a ligature on the door, step (viii) may comprise communicating to an external alarm system via the communication means to activate the external alarm when it has been determined that the load applied by the door is greater than the threshold value for the minimum period of time.

In some embodiments, a power supply is provided configured to provide power to the movement sensing means, the load sensing means, the processing means and where provided, the communication means.

In some embodiments, the door may comprise one or more of the movement sensing means, the load sensing means, the processing means, and where provided, the communication means and/or the power supply. One or more of the movement sensing means, the load sensing means, the processing means and, where provided, the communication means and/or power supply may be provided within the door frame. One or more of the movement sensing means, the load sensing means, the processing means and, wherein provided, the communication means and/or power supply may be provided in the floor at the base of the door frame. In one embodiment, the door comprises the movement sensing means, the load sensing means and the processing means. In one embodiment where a power supply is provided, the door comprises the movement sensing means, the load sensing means, the processing means and the power supply. In one embodiment where a power supply and a communication means is provided, the door comprises the movement sensing means, the load sensing means, the processing means, the communication means and the power supply.

In some embodiments, a plurality of load sensing means may be provided. Each load sensing means within the plurality of load sensing means may be configured to determine the load applied by the door to the mounting means in a separate direction or along a separate axis. Accordingly, the load applied by the door to the mounting means may be determined in multiple directions or along multiple axes.

The invention extends in a second aspect to an apparatus for determining the load applied by a door, the apparatus comprising: mounting means configured to mount the apparatus onto a hinge or pivot; a movement sensor configured to detect movement of the apparatus or a door; a load sensor configured to determine the load applied to the apparatus by the door; and attachment means configured to attach the apparatus onto the door or into the floor or into a door frame.

During normal use, the load applied to the apparatus is typically due to the weight of the door bearing down onto the mounting means upon which the door is installed via the apparatus. However, if a ligature is made between the door and the door frame and a person attempts to kill themselves by hanging from the ligature, the load applied by the door is significantly increased. The apparatus is configured to determine when such a ligature is being used by detecting this increase in the load applied by the door to the apparatus, thereby allowing an alarm to be activated, thereby allowing such an event from being stopped or prevented.

The load sensor may comprise one or more strain gauges. The load sensor may comprise two or more strain gauges.

Alternatively, the load sensor may comprise any alternative suitable device that may be configured to determine the load applied to the apparatus by the door.

The movement sensor may comprise any conventional device that can detect movement of the door and thereby determine when the door is substantially stationary or when the door is moving. For example, the movement sensor may be an accelerometer, a magnet and magnetic angle sensor, an encoder, an optical encoder, or a potentiometer.

The apparatus may be configured to be mounted on a bottom edge of a door. The apparatus may be configured to be mounted on a top edge of a door. The apparatus may be configured to be mounted on a side edge of a door.

In embodiments where the apparatus is configured to be mounted on a bottom edge of a door or on a top edge of a door, the mounting means of the apparatus may be configured to mount the apparatus on a pivot. In embodiments where the apparatus is configured to be mounted on a side edge of a door, the mounting means of the apparatus may be configured to mount the apparatus on a hinge.

As used herein, the terms "top edge", bottom edge", and "side edge" refer to the edges of a door when the door is mounted within a door frame. Accordingly, the term "top edge" typically refers to that edge of a door that is highest in the door frame. The term "bottom edge" typically refers to that edge of a door that is adjacent to the floor at the bottom of the door frame. The term "side edge" typically refers to the edges of the door that extend between the top edge and the bottom edge.

Alternatively, the apparatus may be configured to be mounted in the floor at the base of a door frame or in the door frame itself.

The apparatus may be configured to be mounted into the bottom edge of a door such that the apparatus does not extend beyond the periphery of the door and/or beyond the door frame.

The apparatus may comprise a power supply. The power supply may comprise one or more batteries.

The apparatus may comprise a communication means. Preferably, the communication means is a wireless communication means. Accordingly, the apparatus does not need to be hard-wired into a pre-existing external alarm system in order to activate said external alarm system.

The mounting means may comprise a pivot receiving formation configured to receive a pivot. The mounting means may comprise a pivot configured to be received in an external pivot receiving formation. The external pivot receiving formation may be in a door frame or the floor at the base of the door frame.

The mounting means may comprise a hinge receiving formation configured to receive a hinge pin. The mounting means may comprise a hinge pin configured to be received in a hinge receiving formation. The hinge receiving formation may be a hinge knuckle. The hinge receiving formation may be a plurality of hinge knuckles.

Typically, the apparatus of the present aspect is suitable for use in the method of the first aspect.

According to a third aspect of the invention there is provided a door assembly comprising a door mounted within a door frame on pivoting means such that the door may pivot on the pivoting means, the door comprising the apparatus of the second aspect.

Typically, the door comprises a peripheral edge and the apparatus is mounted on the peripheral edge of the door. The peripheral edge of the door onto which the apparatus is mounted may be along the top of the door, along the bottom of the door or along one of the sides of the door.

In embodiments, the apparatus is sunk into the door such that the apparatus is not visible during use. Accordingly, the apparatus is typically not visible by a user when the apparatus is mounted or installed within the door. Therefore, it is not obvious or apparent to third parties whether or not the door comprises the apparatus of the second aspect and so it is not apparent whether or not the door is alarmed. In addition, such a discrete installation of the apparatus does not contribute to an atmosphere of institutionalisation, or mistrust.

In embodiments where the apparatus comprises a pivot receiving formation, the pivoting means may comprise a first pivot arranged on a first portion of the door frame and the first pivot may be received by the pivot receiving formation of the apparatus such that the door applies a load to the pivot via the apparatus. The pivoting means may further comprise a second pivot, and the second pivot may be arranged on an opposite portion of the door frame to the portion of the door frame upon which the first pivot is arranged such that the door may rotate on the first and second pivots relative to the door frame.

In embodiments where the apparatus comprises a pivot, the pivoting means may comprise a first pivot receiving formation and the pivot of the apparatus may be received in the first pivot receiving formation such that the door applies a load to the first pivot receiving formation via the pivot of the apparatus. The pivoting means may further comprise a pivot, and the pivot of the pivoting means may be arranged on an opposite portion of the door frame to the portion of the door frame upon which the first pivot receiving formation is arranged such that the door may rotate. Alternatively, the pivoting means may further comprise a second pivot receiving formation and may be arranged on an opposite portion of the door frame to the portion of the door frame upon which the first pivot receiving formation is arranged.

In embodiments where the apparatus of the second aspect does not comprise a processor, a power supply and/or a communication device, the door assembly may further comprise a processing unit, the processing unit comprising a processor, a power supply and/or a communication device. Accordingly, the processor unit may be provided adjacent to the apparatus of the second aspect, or at a separation from the apparatus of the second aspect. In this way, the processor unit may be provided in position that is accessible for maintenance, such as when the power supply needs to be replaced, or if the processor unit requires maintenance.

Preferred and optional features of the first to third aspects are preferred and optional features of the first to third aspects.

BRIEF DESCRIPTION OF THE FIGURES

Embodiments of the present invention will now be described, by way of non-limiting example, with reference to the accompanying drawings.

FIGS. 11A-E depict a flow diagram outlining a method according to a further embodiment of the invention, with FIG. 11A showing the method steps in a simplified diagram that is subdivied into four sections, designated B, C, D, and E, which correspond to the subject matter of FIGS. B-E, where FIG. 11B details the portion of the diagram designated B in FIG. 11A, FIG. 11C details the portion of the diagram designated C in FIG. 11A, FIG. 11D details the portion of the diagram designated D in FIG. 11A, and FIG. 11E details the portion of the diagram designated E in FIG. 11A.

DETAILED DESCRIPTION

Figure 1:
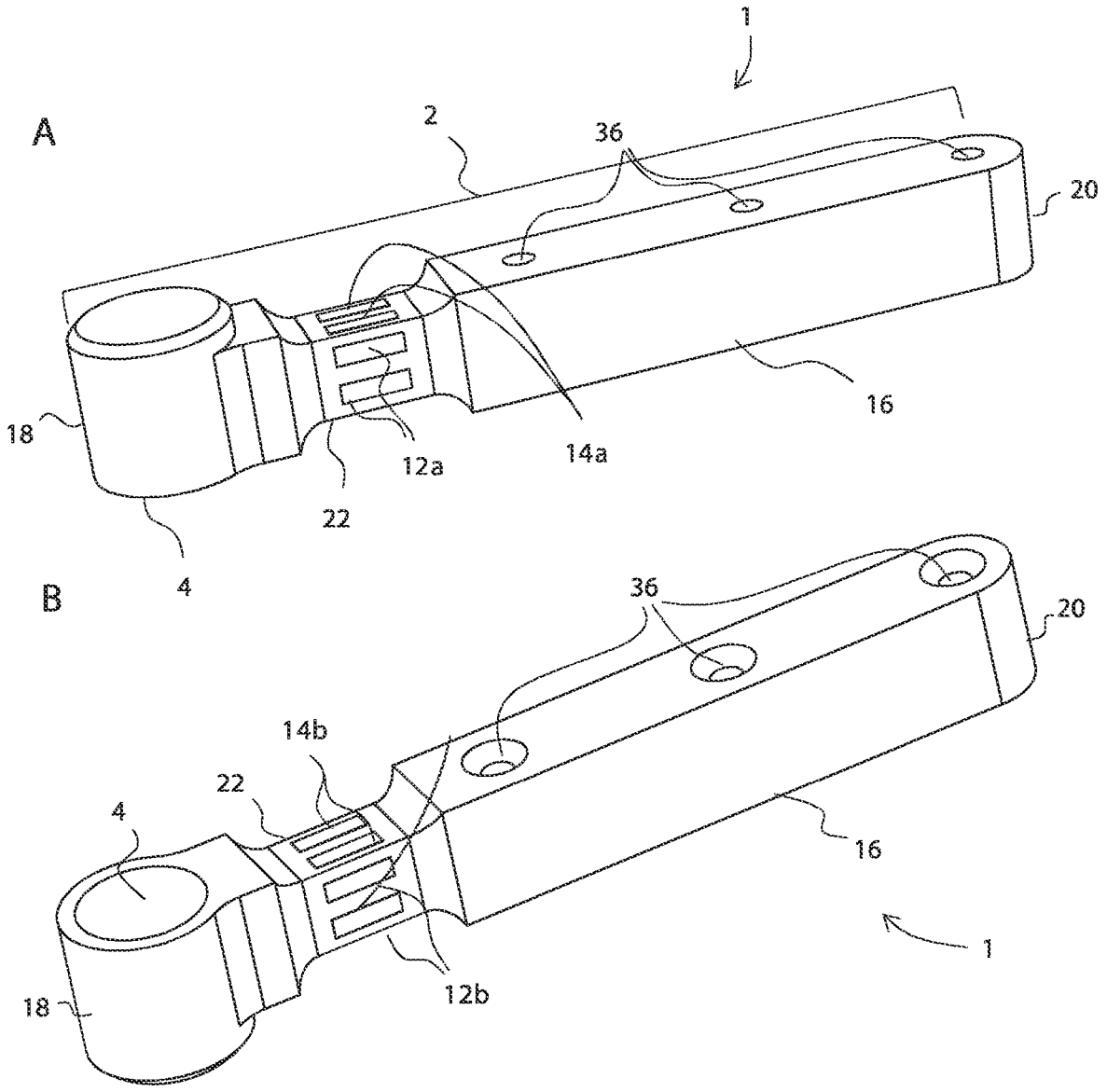
FIG. 1: a side perspective view of an apparatus according to an embodiment of the invention viewed from (A) above, and (B) below.
Figure 2:
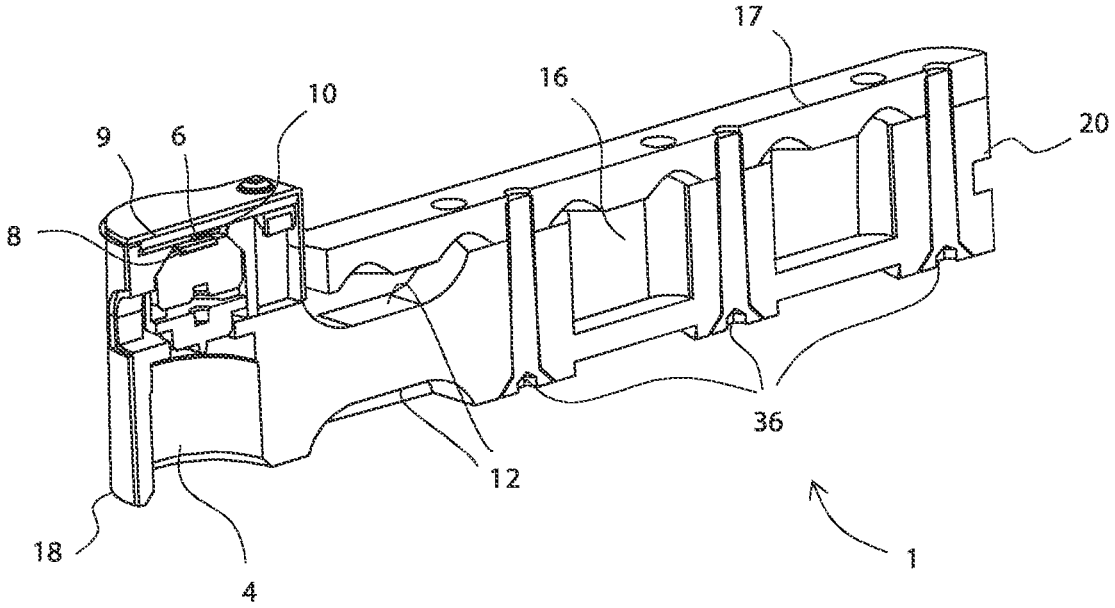
FIG. 2: a cross-sectional view of an apparatus according to an embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Apparatus

With reference to FIGS. 1-4, a load measuring device 1 (acting as an apparatus according to the second aspect) comprises: a main body 2; a pivot cup 4; a magnetic sensor 6 (acting as movement sensing means) comprising a magnet 8, a PCB 9, and a magnetic angle detector 10; a first pair of strain gauges 12*a* and 12*b* (acting as a first load sensing means); a second pair of strain gauges 14*a* and 14*b* (acting as a second sensing means); and a load arm 16. Each of the first pair of strain gauges 12*a* and 12*b* and the second pair of strain gauges 14*a* and 14*b* are connected as Wheatstone bridges to form a two axis load sensor. The pivot cup 4 is positioned at a first end 18 of the load measuring device 1 with the load arm 16 extending away from the pivot cup 4 to a second end 20. The load arm 16 is connected to the pivot cup 4 by a connector 22 having four sides. The first pair of strain gauges 12*a* and 12*b* are mounted onto two opposing sides of the connector 22 and the second pair of strain gauges 14*a* and 14*b* are mounted onto the two remaining opposing sides of the connector 22.

The pivot cup 4 is configured to receive a pivot 24 upon which the load measuring device 1, and any door 26 to which the load measuring device 1 is installed, is mounted. The magnetic sensor 6 is located within the pivot cup 4 such that a pivot 24 received by the pivot cup 4 is attached to the magnet 8 of the magnetic sensor 6, such that as the load measuring device 1 and the door 26 within which the load measuring device 1 is installed is opened or closed, the magnet 8 moves relative to the magnetic angle detector 10, thereby allowing the movement of the load measuring device 1 and the door 26 to be detected.

Figure 3:
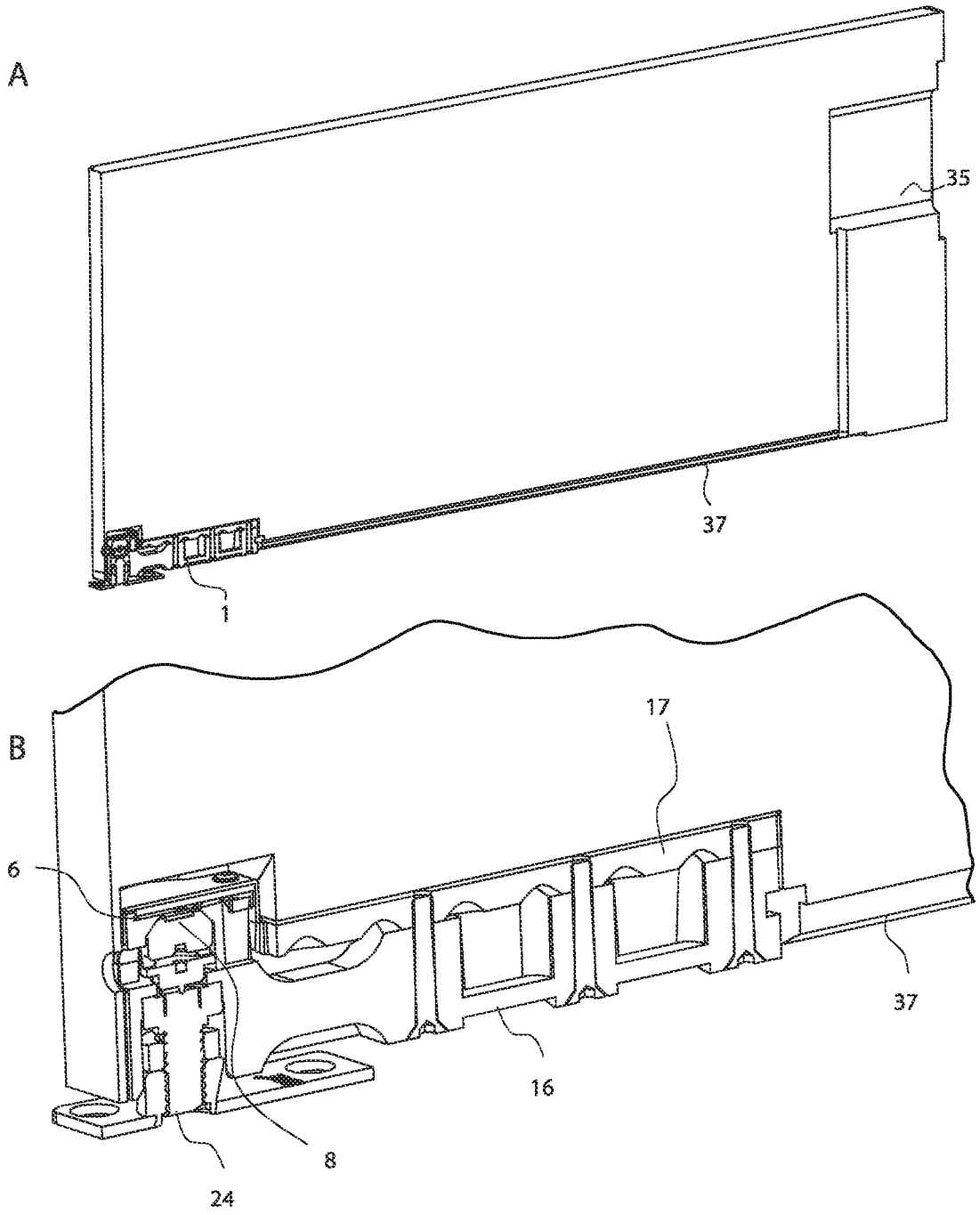
FIG. 3: a perspective side view of (A) the lower portion of a door comprising the apparatus according to an embodiment of the invention, and (B) a zoomed in view of the apparatus according to an embodiment of the invention shown in (A)
Figure 7:
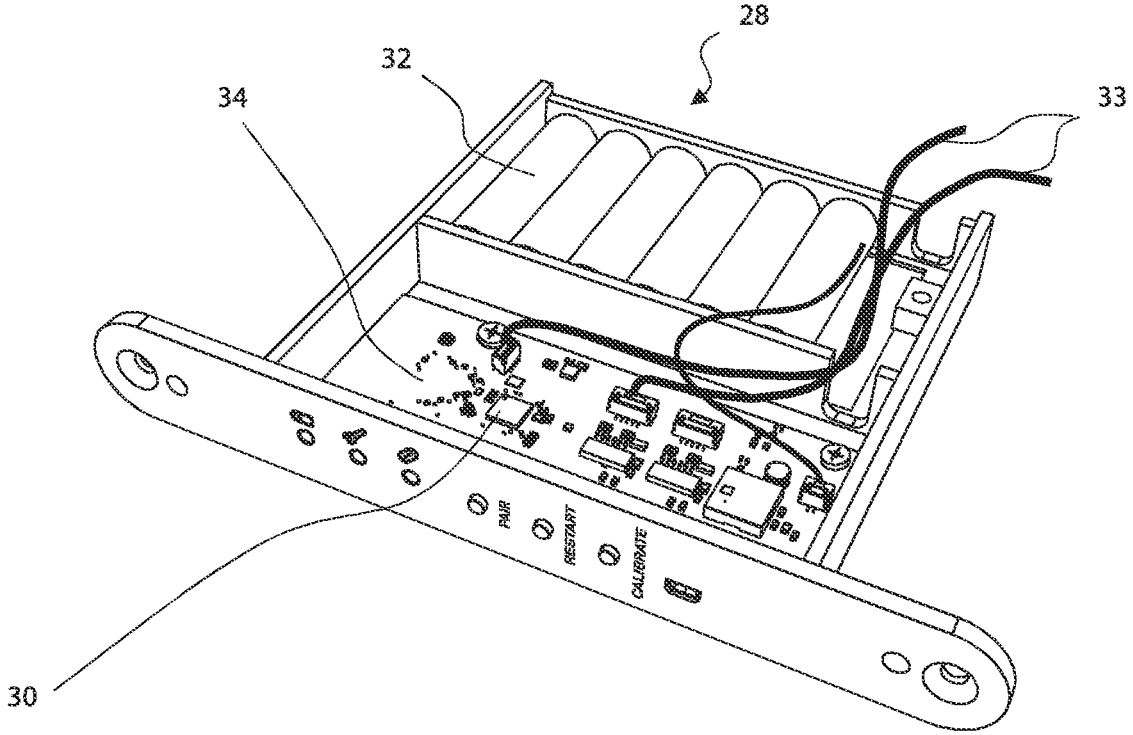
FIG. 7: a perspective view of a processing unit according to an embodiment.

With reference to FIGS. 3 and 7, a processing unit 28 comprises a processor 30, a battery 32 (acting as a power supply), and a wireless communication device 34. The processing unit 28 is located in a recess 35 adjacent to a peripheral edge of the door within which the load measuring device 1 is installed and is electrically connected to the load sensor and to the magnetic sensor 6 by wires 33 that pass through a cable channel 37 between the load measuring device 1 and the processing unit 28.

The load arm 16 further comprises through holes 36. Each through hole 36 allows a screw or bolt to be threaded through the load arm 16 to attach the load measuring device 1 to a carrier bracket 17 within the bottom peripheral edge of a door.

Figure 6:
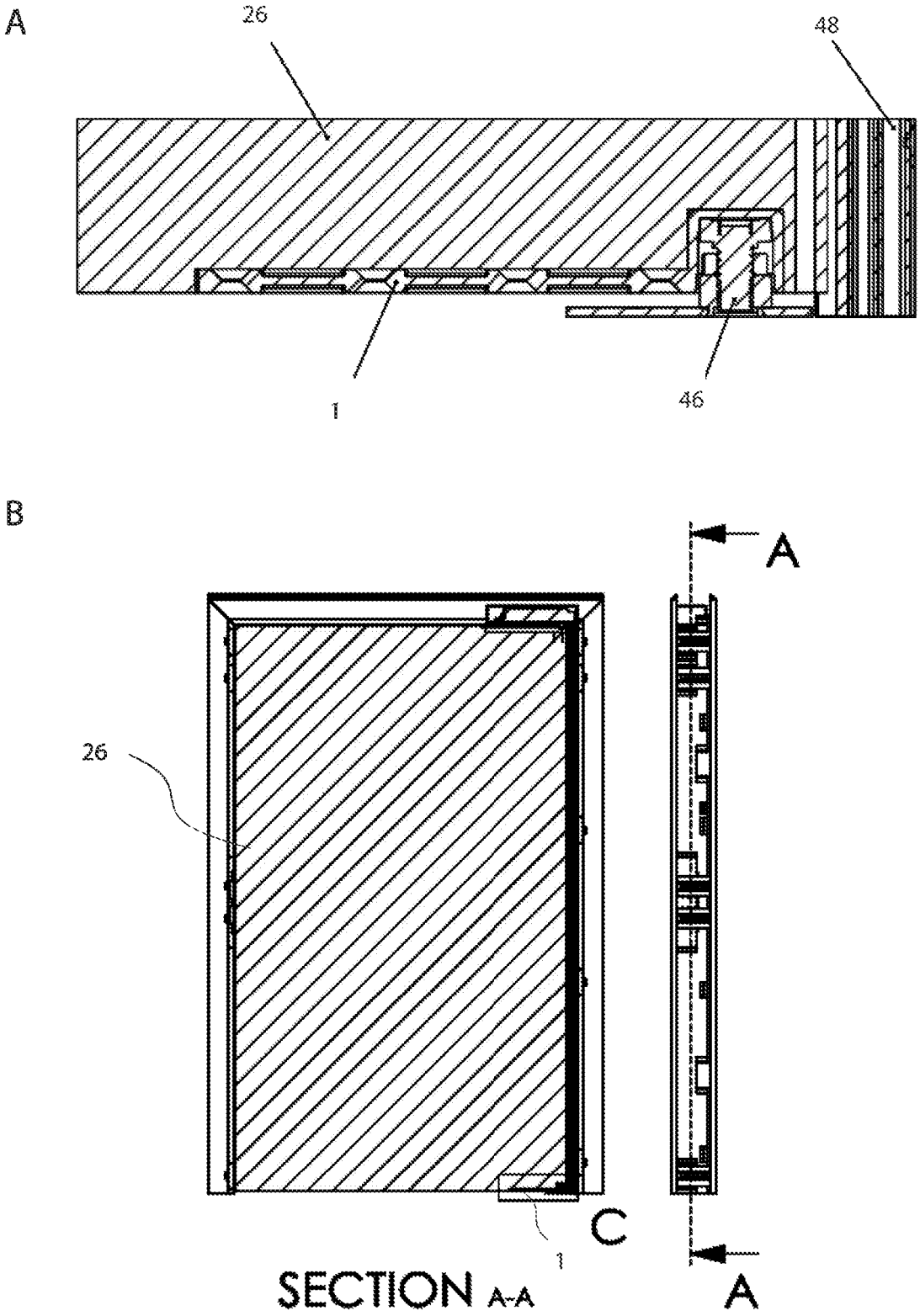
FIG. 6: (A) a schematic side view of a door section comprising apparatus according to an embodiment of the invention installed within the bottom peripheral edge mounted onto a bottom pivot, and (B) a schematic side view of the door comprising the door section of (A)

The load measuring device 1 is attached to a door by creating a recess 38 within the bottom peripheral edge 40 of a door adjacent to the side edge 42 of the door that will be mounted to a door frame. For example, FIG. 4B and FIG. 6 shows a load measuring device 1 installed within a door 26.

Figure 4:
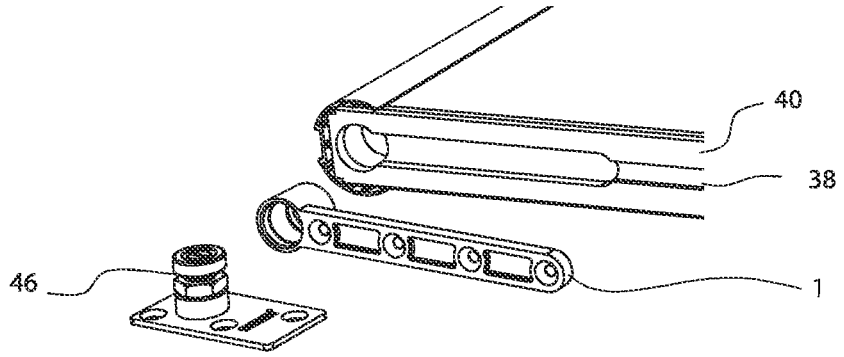
FIG. 4: (A) an exploded perspective view from beneath showing an embodiment of the apparatus of the invention, a pivot installed in a floor and a door section within which the apparatus is to be installed, and (B) a perspective view from beneath showing the apparatus installed into the door section.
Figure 4:
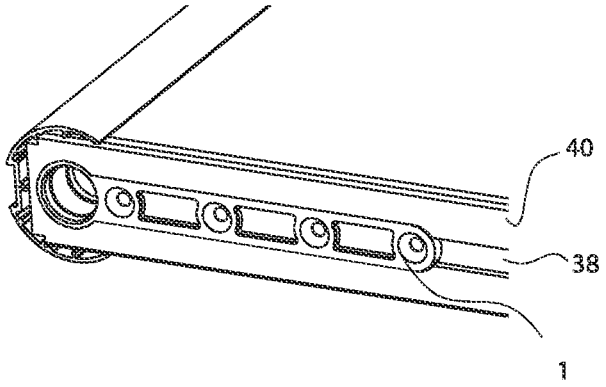
Figure 5:
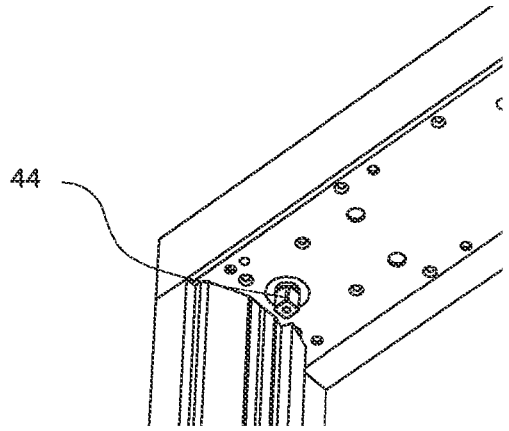
FIG. 5: (A) a perspective view from below of a top pivot onto which a door may be mounted, (B) a perspective view from above of a door section having a mounting means attached, and (C) a plate comprising the top pivot shown in (A), and (C) mounting means as shown in (B)
Figure 5:
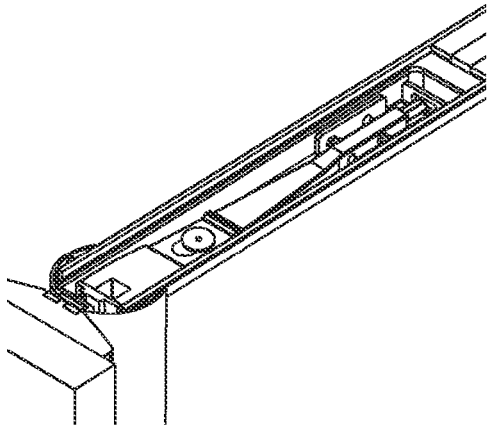
Figure 5:
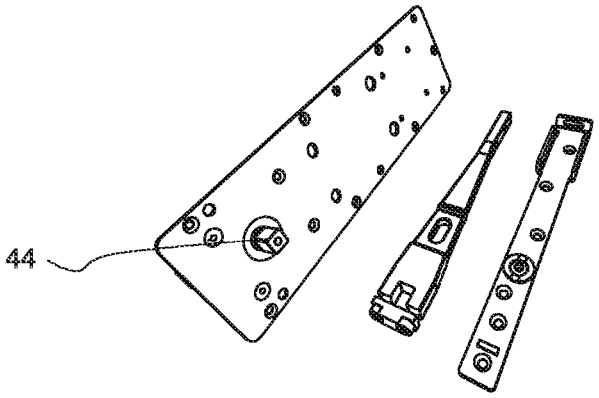

Once the load measuring device 1 has been installed within a door 26, the door 26 is mounted onto a top pivot 44 such as that shown in FIG. 5, and a bottom pivot 46 within a door frame 48, such as that shown in FIG. 4. Accordingly, the door may open and close within the door frame by rotating on the top and bottom pivots.

Method of Use

As described above, where two hard surfaces are in contact, there is potential for a ligature point that can hold a ligature firmly to allow a person to use that ligature to harm themselves, or even potentially kill themselves. Accordingly, wherever the door and door frame come together when the door is closed, a potential ligature point is formed. Therefore, the sides, bottom and top of the door can be the site of a ligature point. Unsuitable ironmongery, damage to components, or incorrect fitting of components to the door may also present ligature risks.

Once installed, the door applies a load to the load measuring device, due predominantly to the weight of the door. As the door opens and closes, the applied load may vary. Indeed, the inventors have found that the applied load varies greatly, even when the door stops in the same place, such as when it is closed.

The load applied by the door to the load measuring device that is the result of a ligature being used will vary depending on the site of the ligature point.

Figure 8:
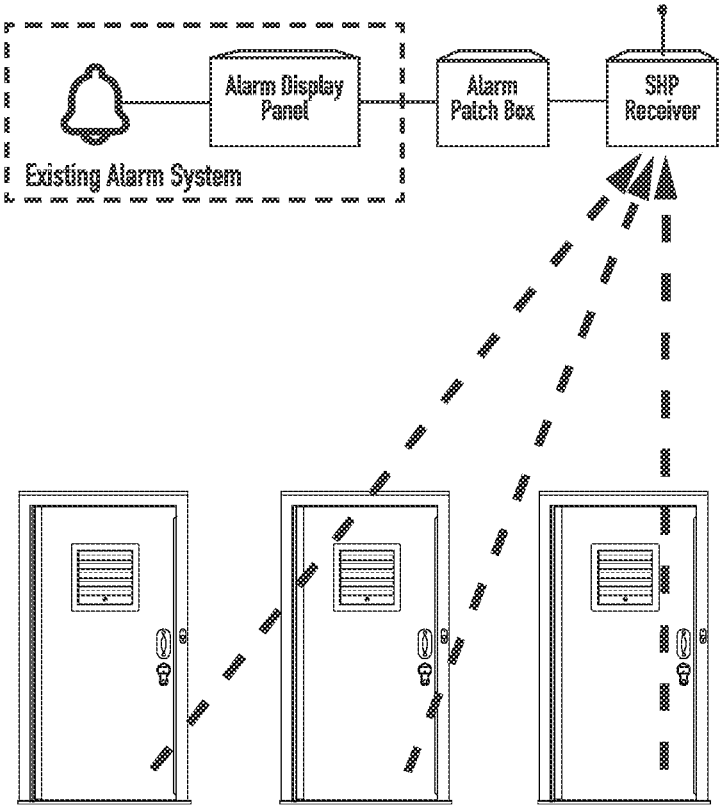
FIG. 8: a schematic view of a system comprising multiple doors within which the apparatus according to an embodiment of the invention has been installed indicating how the apparatus in each door communicates wirelessly to an external, existing alarm system to trigger an alarm.

When a ligature is detected by the load measuring device the wireless communication device triggers an external alarm system, such as the system shown schematically in FIG. 8. The wireless communication device includes an identification tag with the communication to trigger the alarm to ensure that it is clear the identity of the door at which a ligature has been detected.

Accordingly, in an institution within which a plurality of doors have been equipped with load measuring devices, the staff that are to respond to the alarm are able to identify which door and therefore which room needs urgent attention.

Algorithm

The load measuring device can determine whether a ligature is present on a door by a number of different ways. Two examples are shown in the flow diagrams of FIGS. 10 and 11 as described below.

Method 1

Figure 10:
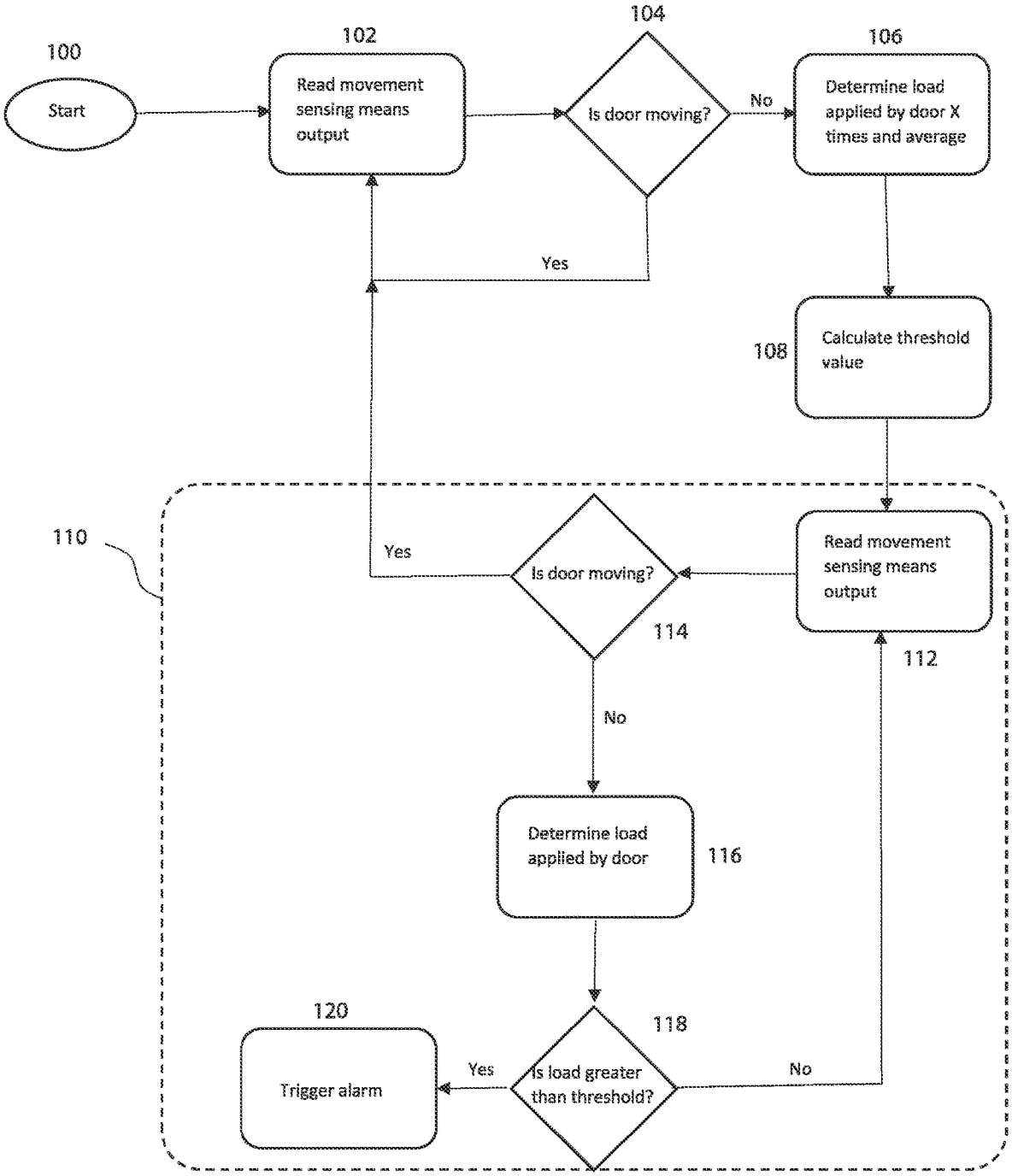
FIG. 10: a flow diagram outlining a method according to an embodiment of the invention.
Figure 11A:
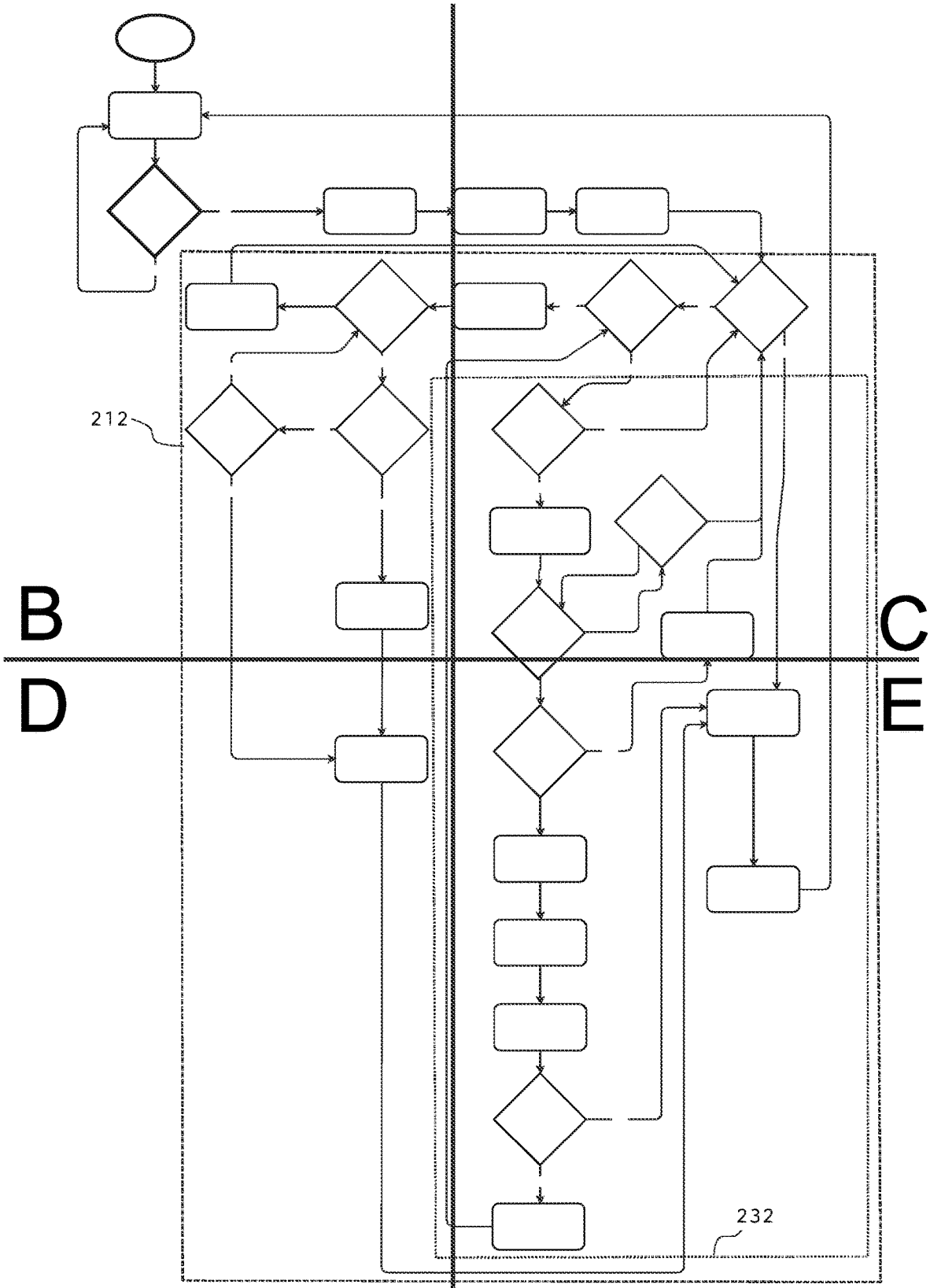
FIGS. 11A-E.
Figure 11B:
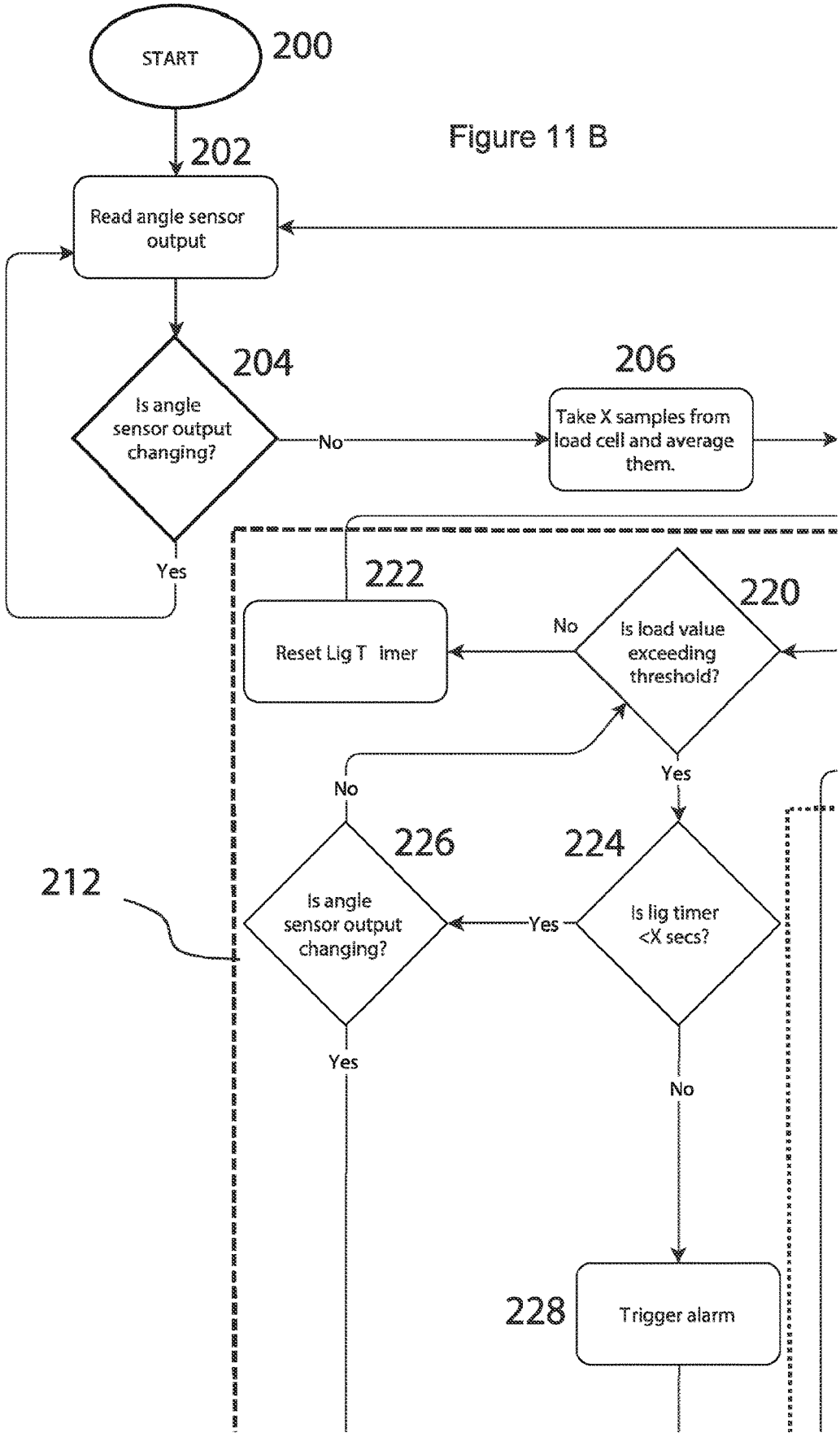
Figure 11C:
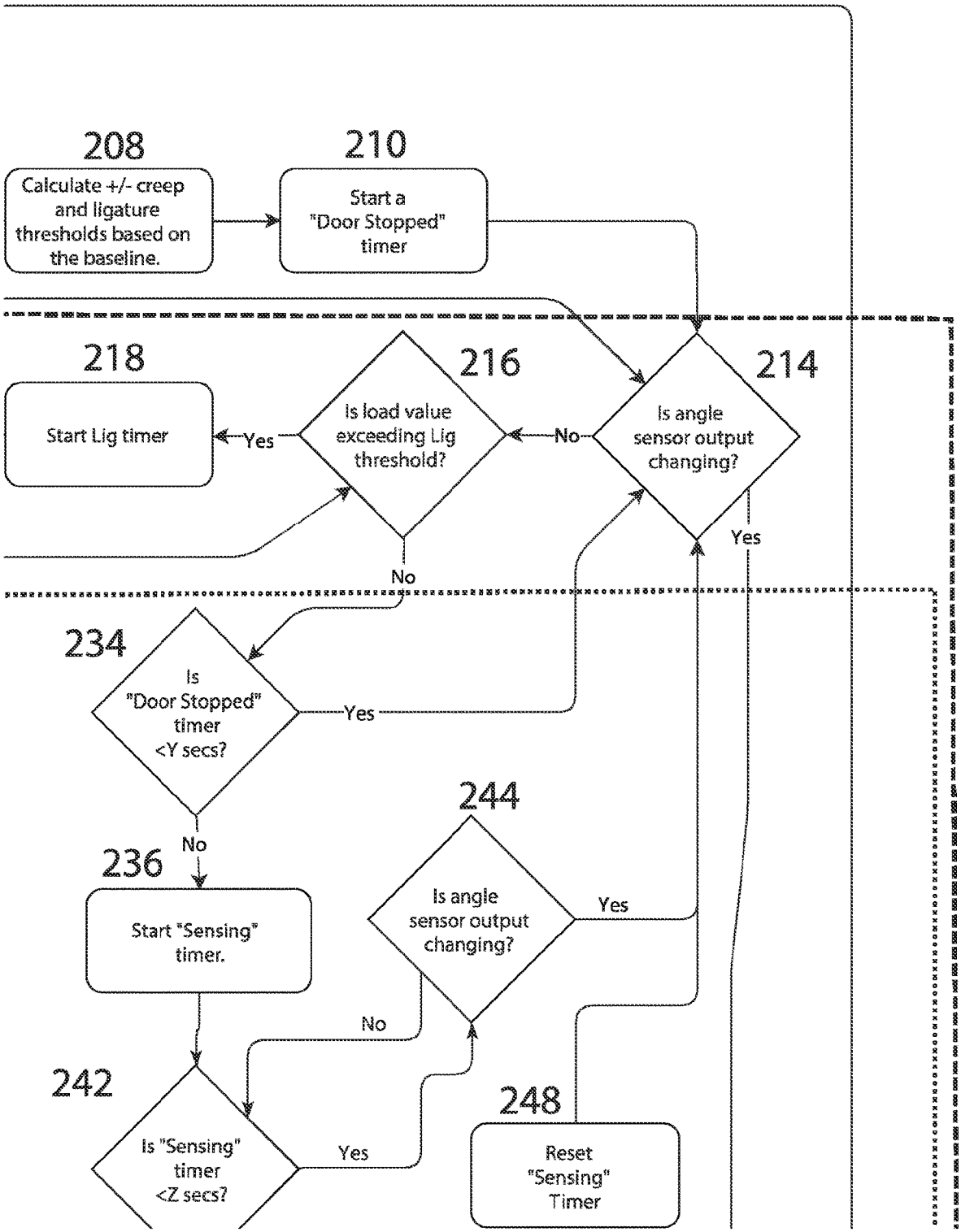
Figure 11D:
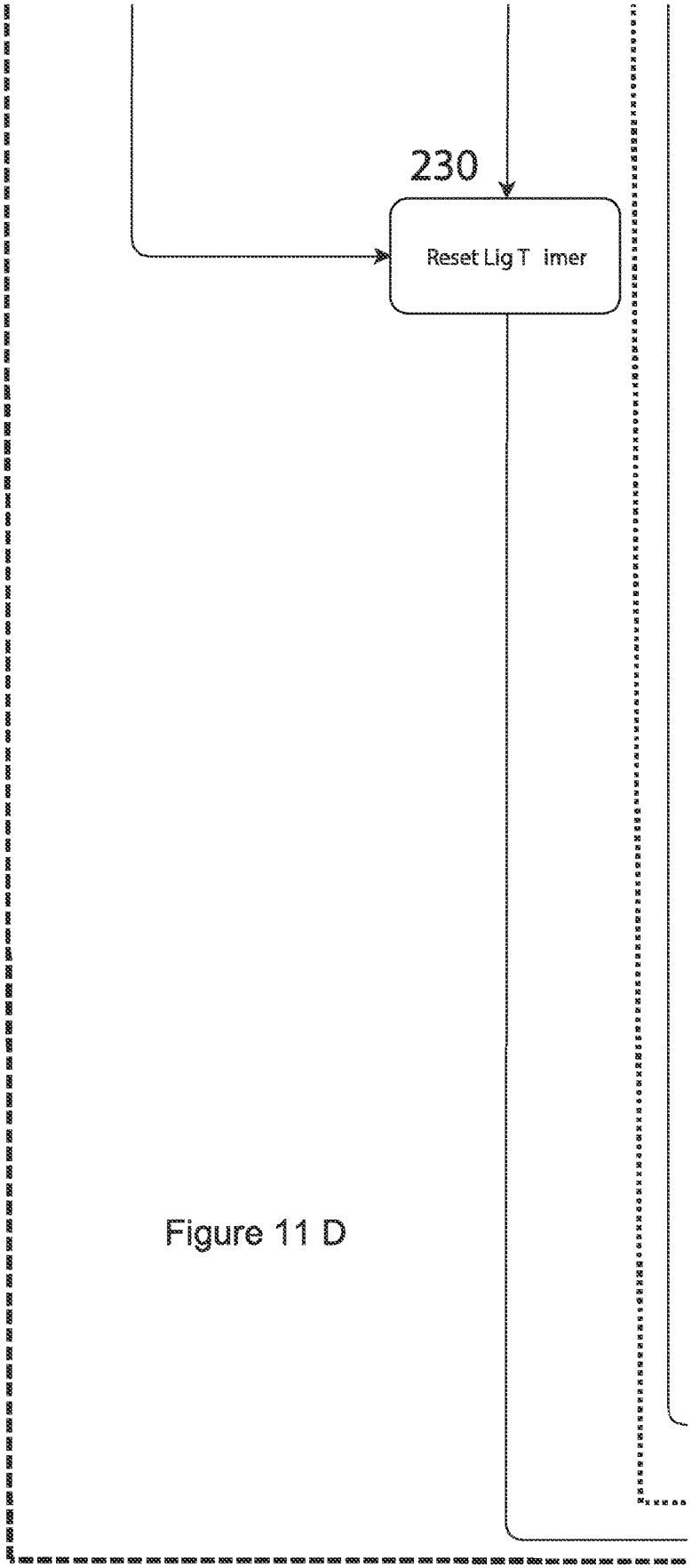
Figure 11E:
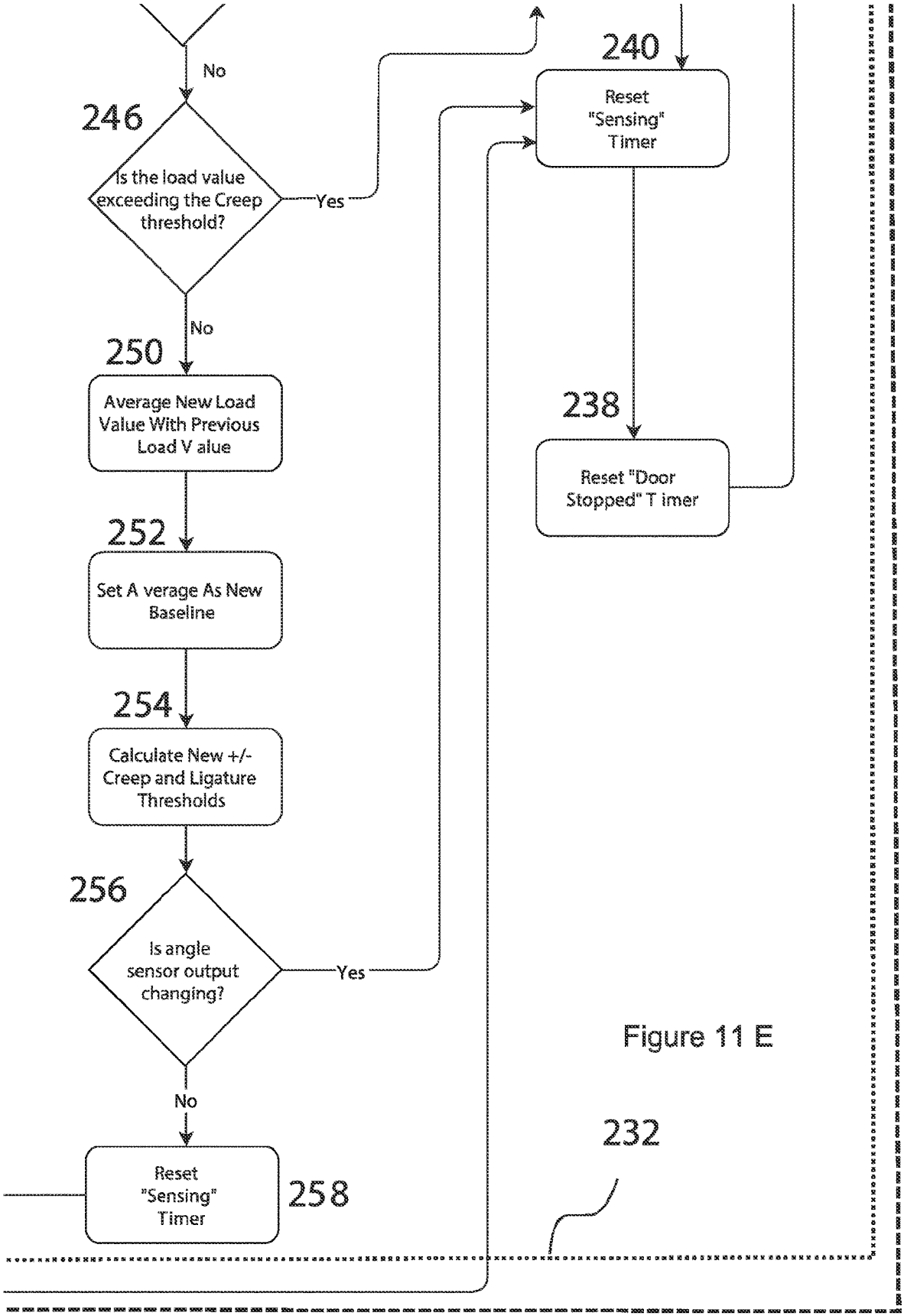
Figure 12:
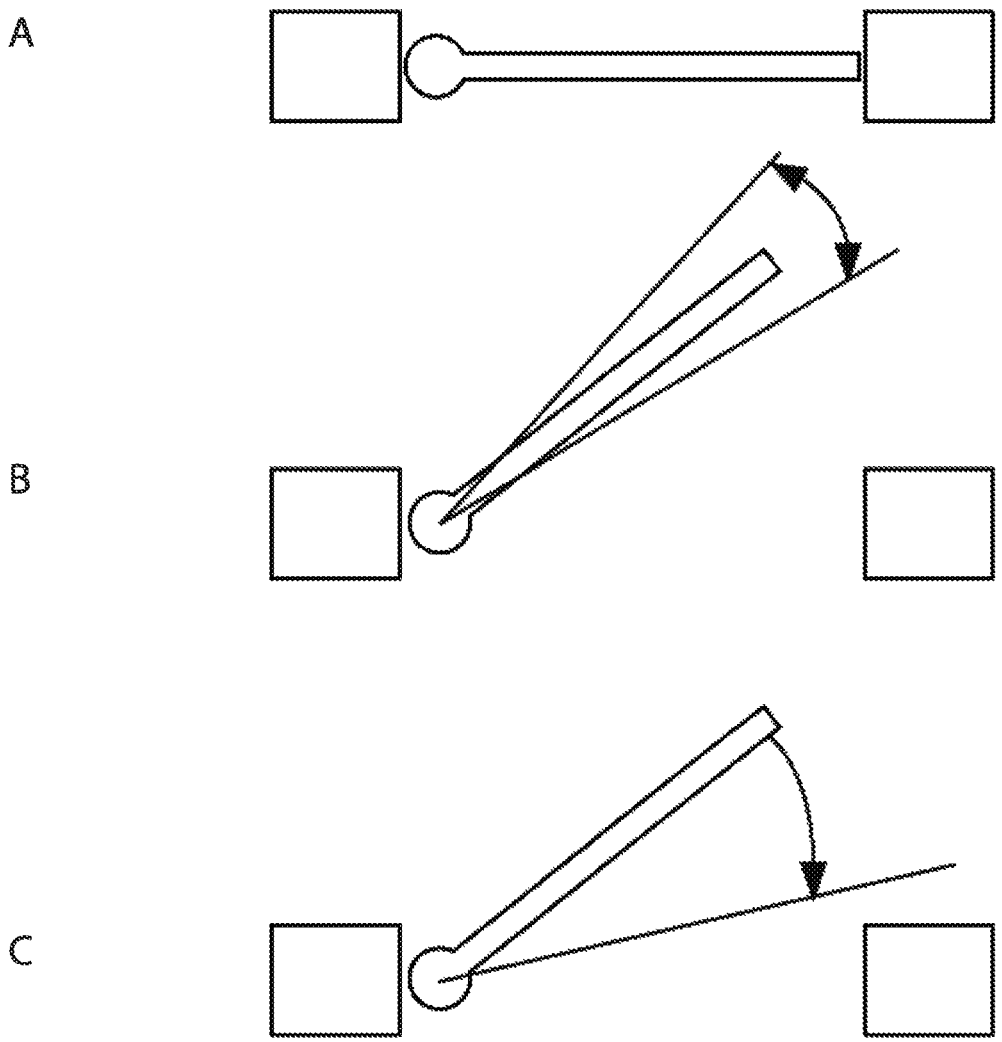
FIG. 12: Examples of substantially stationary doors (A) door stationary in closed position, (B) door not moving out with a range of 0-10 degrees, and (C) door moving at less than ~3 to ~10 degrees per second.

With reference to FIG. 10, once installed, the load measuring device begins 100 by reading 102 the magnetic sensor (movement sensing means) and determining 104 whether the door within which it is installed is moving relative to the door frame. If the door is not moving, the load measuring device determines 106 the load applied to the load measuring device by the door a plurality of times ("X times" in FIG. 10), where the plurality of times may be 3, 4, 5, 6, 7, 8, 9, 10, 12, 15 or more times. The resulting plurality of readings are averaged to produce a baseline, averaged load reading. Once the baseline has been established, a threshold value is calculated 108. The load measuring device then proceeds in a monitoring loop 110 to read the magnetic sensor 112 to determine whether the door is moving 114 and measuring the applied load to the load measuring device 116. As long as the door is determined to be stationary, the load is continually monitored. If the load is determined to exceed the threshold value 118 for longer than the time required, the load measuring device communicates to the external alarm that a ligature is present and thereby triggers the alarm 120. If a load is not determined to exceed the threshold value, the monitoring loop is repeated.

Once the door is determined to move during the monitoring loop the load measuring device resets and begins the process again from the beginning 102.

In this way, the load measuring device re-calculates the baseline load and the threshold value every time the door is determined to have stopped moving after the door has been determined to be moving. In other words, the load measuring device re-calculates the baseline load and threshold value each time the door is moved, thereby taking into account changes in the load that are not due to ligatures.

Method 2

In an alternative example, the load measuring device comprises a timer that is configured to measure the time that has elapsed from when certain actions are performed.

Figure 9:
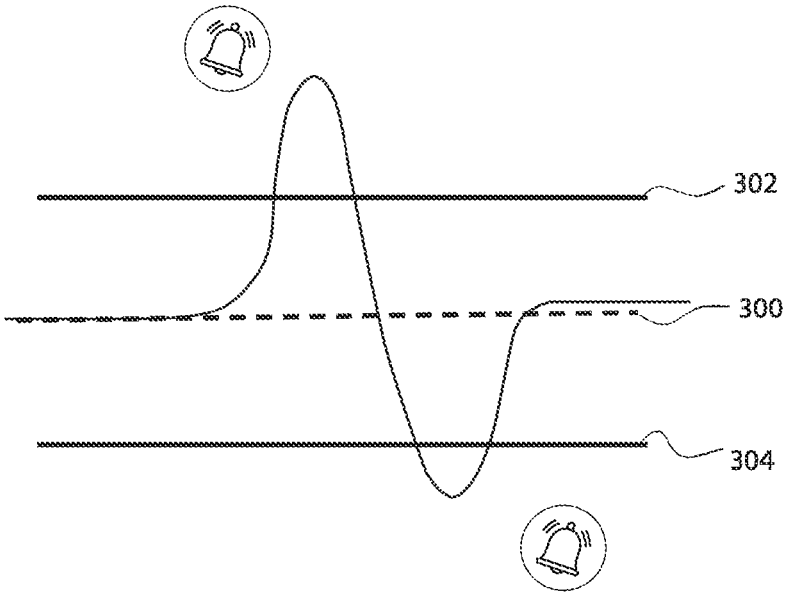
FIG. 9: an example trace of the determined load as a function of time including positive and negative threshold values.

With reference to FIG. 11, the load measuring device begins 200 by reading 202 the magnetic sensor to determine 204 whether the door within which it is installed is moving relative to the door frame i.e. the magnetic sensor output is changing. If the door is not moving, the load measuring device determines 206 the load applied to the load measuring device by the door a plurality of times ("X samples" in FIG. 11), where the plurality of times may be 3, 4, 5, 6, 7, 8, 9, 10, 12, 15 or more times. The resulting plurality of readings are averaged to produce a baseline 300, averaged load reading. Once the baseline has been established, a positive ligature threshold value 302 is calculated and a negative ligature threshold value 304 is calculated 208 (see FIG. 9, for example), a positive creep threshold value is calculated, a negative creep threshold value is calculated and a "door stopped" timer is started 210.

Monitoring Loop

The load measuring device then proceeds in a monitoring loop 212 to monitor whether the door is moving and measuring the applied load to the load measuring device. If the door is determined to be moving 214, the "door stopped" timer is reset 238 and the load measuring device reverts to the beginning of the process 202. As long as the door is determined to be stationary, the load is continually monitored.

If the door is not moving, the load measuring device determines 216 whether the load falls outside the ligature threshold values. If the load is determined to be greater than the positive ligature threshold value 302 or less than the negative ligature threshold value 304, a Ligature (or "Lig") timer is started 218. The load measuring device determines again 220 whether the load falls outside the ligature threshold values. If the load does not fall outside the ligature threshold values, the Lig timer is reset 222 and the monitoring loop is restarted from point 214. If the load does fall outside the ligature threshold values, the load measuring device determines 224 whether the Lig timer value is less than a predetermined value ("<X secs" in FIG. 11, for example, 2-3 seconds). If the Lig timer value is less than the predetermined value, the load measuring device determines 226 whether the door is moving and if the door is not moving reverts to step 220. If the door is moving, the Lig timer is reset 230 and load measuring device resets to the beginning of the process 202, resetting 240 the sensing timer (to be described below) and resetting 238 the door stopped timer. If the Lig timer value is greater than the predetermined value, the load measuring device communicates to the external alarm system to trigger the alarm 228 and the Lig timer is reset 230. The load measuring device then resets to the beginning of the process 202, resetting 240 the sensing timer (to be described below) and resetting 242 the door stopped timer.

Creep or Drift Compensation

If the load is determined 216 to be within the normal range of values (i.e. between the positive ligature threshold value and the negative ligature threshold value), the load measuring device starts a creep or drift loop 232 and determines 234 whether the "door stopped" timer value is greater than a predetermined value ("<Y secs" in FIG. 11, for example 30 seconds). If the door stopped timer value is less than the predetermined value, the load measuring device reverts to step 214. If the door stopped timer is equal to or greater than the predetermined value, the load measuring device starts a "sensing" timer 236. The load measuring device then determines 242 whether the sensing timer value is greater than a predetermined value ("<Z secs" in FIG. 11, for example 10 seconds). If the sensing timer value is less than the specific value, the load measuring device determines whether the angle sensor output is changing 242. If the angle sensor output is changing the load measuring device reverts to step 214. If the angle sensor output is not changing the load measuring device reverts to step 242. If the sensing timer is equal to or greater than the predetermined value, the load measuring device determines whether the load value exceeds the creep threshold 246. If the load value exceeds the creep threshold the load measuring device resets the "sensing" timer 248. If the load value is less than the creep threshold, the load measuring device averages the new load value with the previous load value 250 to produce a new average load value. The new average load value is then set 252 as the new baseline, and new positive and negative creep and ligature threshold values are calculated 254. The load measuring device then determines 256 whether the door is moving by determining whether the angle sensor output is changing. If the door is moving, the load measuring device reverts to step 202 resetting the sensing timer 240 and door stopped timer 238. If the door remains stationary, the "sensing" timer is reset 258 and the load measuring device reverts to step 216.

In the event that the load is determined to be above the positive creep threshold and the positive ligature threshold, or below the negative creep threshold and the negative ligature threshold at point 246, the load measuring device will go to point 218 and start the Lig timer. Accordingly, the creep or drift compensation loop will be stopped and the load measuring device will determine whether a ligature is present as described above.

If at step 244 the door is determined to be moving, the sensing timer is reset 240, the door stopped timer is reset 238, and the load measuring device resets to step 202.

The timer/variable values provided above are adjustable to any range that is required by a given application and setting. The examples given above are indicative of an example that has been found to work in a given setting, but these values can be adjusted to suit specific installations. Accordingly, the values provided above are merely an exemplification of an embodiment of the invention and should not be construed as limiting.

Alternative Examples

Whilst the above examples are described in detail it will be understood that changes and modification may be made to the above described apparatus and methods whilst remaining within the scope of the invention.

In an alternative example, the load measuring device comprises a processing unit, and the door within which the load measuring device is installed does not comprise a processing unit.

In another example, the load measuring device comprises a plurality of hinge knuckles configured to receive the hinge pin of a standard hinge such that the door within which the load measuring device is installed may be mounted onto a door frame using a standard hinge. The load measuring device is installed into the side peripheral edge of the door adjacent to the standard positioning of the bottom hinge for door hinges.

In yet a further example, the processing unit carries out signal smoothing on the data received by the processing unit from the load sensing means. Accordingly, noise in the signal from the load sensing means producing a false baseline average or triggering of the alarm is prevented or its effect on the same is at least reduced.

In a further example, a plurality of load sensing means are provided and the apparatus is configured to determine the load applied by the door to the apparatus in two or more axes.

Accordingly, the apparatus is configured to indicate whether a component is going to fail or needs to be adjusted. For example, this could be that the closing speed is badly adjusted and causing the door to slam or that someone has attacked the door requiring a safety check to ensure all components still intact.

In another example, the load measuring device comprises a single load sensing means. In another example, the load measuring device comprises a single pair of load sensing means combined in a wheatstone bridge. For example, the load measuring device may comprise the first pair of strain gauges as described above only. The load measuring device may comprise the second pair of strain gauges only.

In an alternative to Method 1, once an initial threshold value 108 has been calculated the load measuring device reads the movement sensing means output 112, and if the door is determined to be moving at step 114 the load measuring device reverts to step 112, rather than step 102. Accordingly, the threshold value is not recalculated each time the door is determined to be moving. The "fingerprint" for the specific door being used may be taken upon installation by recording the load output at one or more angles with respect to the door frame and applying a threshold offset accordingly.

The invention claimed is:

1. A method of detecting a ligature on a door, the method comprising the steps:

(i) providing a door mounted within a door frame on mounting means, movement sensing means configured to determine whether the door is moving relative to the door frame, load sensing means configured to determine a load applied by the door to the mounting means, and processing means;

(ii) determining whether the door is substantially stationary using the movement sensing means;

(iii) when the door is determined to be substantially stationary, determining the load applied by the door a plurality of times to provide a plurality of load readings;

(iv) averaging the plurality of load readings to produce an average load reading;

(v) calculating a threshold value from the average load reading;

(vi) determining the load applied by the door; and (vii) | determining whether the load applied by the door in step (vi) is greater than the threshold value, wherein a load that is greater than the threshold value Is indicative of the ligature on the door.

2. The method of claim 1, wherein steps (ii) to (v) are carried out every time the door becomes substantially stationary after moving.

3. The method of claim 1, wherein steps (ii) to (v) are carried out periodically after the door is determined to be substantially stationary.

4. The method of claim 1, wherein, where it is determined that the load applied by the door is not greater than the threshold value, step (vi) is repeated to continuously monitor whether a ligature is being made at a ligature point between the door and the frame.

5. The method of claim 1, wherein step (vi) comprises determining whether the load applied by the door becomes greater than the threshold value for at least a specified period.

6. The method of claim 1, wherein step (v) comprises calculating a positive threshold value and a negative threshold value from the average load reading.

7. The method of claim 6, wherein step (vi) comprises determining whether the load applied by the door becomes greater than the positive threshold value or becomes less than the negative threshold value, and wherein a load applied by the door that is either greater than the positive threshold value or is less than the negative threshold value may be indicative of the ligature on the door.

8. The method of claim 1, wherein a communication means is provided and the method comprises the step (vii) when the load applied by the door is determined to be greater than the threshold value, communicating to an external alarm system via the communication means to activate the external alarm.

9. An apparatus for determining a load applied by a door, the apparatus comprising: mounting means configured to mount the apparatus onto a hinge or pivot; a movement sensor configured to detect movement of the apparatus or a door; at least one load sensor configured to determine the load applied to the apparatus by the door when the door is substantially stationary; and attachment means configured to attach the apparatus onto the door or into the floor or into a door frame or into a door closer in the head of the door frame.

10. The apparatus of claim 9, wherein the at least one load sensor comprises one or more strain gauges.

11. The apparatus of claim 9, wherein the apparatus is configured to be mounted on a bottom edge of a door.

12. The apparatus of claim 11, wherein the apparatus is configured to not extend beyond the periphery of the door within which it is mounted.

13. The apparatus of claim 9, comprising a power supply.

14. The apparatus of claim 9, comprising a communication means.

15. A door assembly comprising, in combination:

a door mounted within a door frame on pivoting means such that the door may pivot on the pivoting means; and an apparatus for determining a load applied by the door, the apparatus comprising mounting means configured to mount the apparatus onto a hinge or pivot, a movement sensor configured to detect movement of the apparatus or the door, at least one load sensor configured to determine the load applied to the apparatus by the door when the door is substantially stationary, and attachment means configured to attach the apparatus onto the door or into the floor or into a door frame or into a door closer in the head of the door frame.

16. The door assembly of claim 15, wherein the door comprises a peripheral edge and the apparatus is mounted on the peripheral edge of the door.

17. The door assembly of claim 16, wherein the apparatus is sunk into the door such that the apparatus is not visible during use.

18. The door assembly of claim 15, wherein the pivoting means comprises a first pivot arranged on a first portion of the door frame and the first pivot is received by the mounting means of the apparatus such that the door applies the load to the pivot via the apparatus.

19. The door assembly of claim 18, wherein the pivoting means comprises a second pivot, and the second pivot is arranged on an opposite portion of the door frame to the portion of the door frame upon which the first pivot is arranged such that the door may rotate on the first and second pivots relative to the door frame.

20. The door assembly of claim 15, further comprising a processing unit, the processing unit comprising a processor, a power supply and a communication device.

21. A method of detecting a ligature on a door, the method comprising the steps:

(i) providing a door mounted within a door frame on mounting means;

(ii) providing an apparatus for determining a load applied by the door, the apparatus comprising mounting means configured to mount the apparatus onto a hinge or pivot, a movement sensor configured to detect movement of the apparatus or the door, at least one load sensor configured to determine the load applied to the apparatus by the door, and attachment means configured to attach the apparatus onto the door or into the floor or into a door frame or into a door closer in the head of the door frame;

(iii) determining whether the door is substantially stationary using the movement sensor;

(iv) when the door is determined to be substantially stationary, determining a plurality of times via the at least one load sensor the load applied by the door so as to provide a plurality of load readings;

(v) averaging the plurality of load readings to produce an average load reading;

(vi) calculating a threshold value from the average load reading;

(vii) determining the load applied by the door; and (viii) determining whether the load applied by the door in step (vii) is greater than the threshold value, wherein a load that is greater than the threshold value is indicative of the ligature on the door.

* * * * *